US006361079B1

(12) United States Patent
Kirkman

(10) Patent No.: US 6,361,079 B1
(45) Date of Patent: Mar. 26, 2002

(54) LABELS FOR DETECTING COUNTERFEIT PRODUCTS

(75) Inventor: Stephen D. Kirkman, High Point, NC (US)

(73) Assignee: Wayne Trademark Manufacturing Company, High Point, NC (US)

( * ) Notice: Subject to any disclaimer, the term of this patent is extended or adjusted under 35 U.S.C. 154(b) by 0 days.

(21) Appl. No.: 09/425,796

(22) Filed: Oct. 25, 1999

(51) Int. Cl.[7] ..... B42D 15/00

(52) U.S. Cl. ..... 283/81; 283/72; 283/85; 283/91; 283/101

(58) Field of Search ..... 283/72, 81, 82, 283/85, 86, 89, 91, 92, 94, 98, 100, 101

(56) References Cited

U.S. PATENT DOCUMENTS

| | | | | |
|---|---|---|---|---|
| 4,862,143 A | | 8/1989 | Hirshfield et al. | 340/572 |
| 4,889,365 A | | 12/1989 | Chouinard | 283/70 |
| 5,020,831 A | | 6/1991 | Benardelli | 283/108 |
| 5,042,842 A | | 8/1991 | Green et al. | 283/101 |
| 5,135,262 A | * | 8/1992 | Smith et al. | 283/94 |
| 5,360,628 A | | 11/1994 | Butland | 427/7 |
| 5,592,561 A | | 1/1997 | Moore | 382/103 |
| 5,599,578 A | | 2/1997 | Butland | 427/7 |
| 5,605,230 A | | 2/1997 | Marino, Jr. et al. | 206/534 |
| 5,619,025 A | | 4/1997 | Hickman et al. | 235/454 |
| 5,651,615 A | | 7/1997 | Hurier | 283/92 |
| 5,660,925 A | * | 8/1997 | Cooley et al. | 428/304.4 |
| 5,786,219 A | | 7/1998 | Zhang et al. | 436/523 |
| 5,841,528 A | | 11/1998 | Lewis et al. | 356/237 |
| 5,869,160 A | * | 2/1999 | Mason et al. | 428/40.2 |
| 5,900,610 A | * | 5/1999 | Kelly, Jr. | 235/385 |

FOREIGN PATENT DOCUMENTS

| | | |
|---|---|---|
| EP | 0342982 | 11/1989 |
| GB | 2122545 A | 1/1984 |
| GB | 2182632 A | 5/1987 |
| GB | 2302308 A | 1/1997 |
| JP | 8156393 A | 6/1996 |
| JP | 9160497 A | 6/1997 |
| JP | 9258661 A | 10/1997 |
| JP | 9297536 A | 11/1997 |
| WO | 90/16043 | 12/1990 |
| WO | 94/16144 | 7/1994 |

* cited by examiner

*Primary Examiner*—A. L. Wellington
*Assistant Examiner*—Monica Carter
(74) *Attorney, Agent, or Firm*—MacCord Mason PLLC

(57) ABSTRACT

A commercial product has a label to help detect counterfeit ones of the product. The product includes an item having commercial value and a label adhered to the item. The label includes a printable substrate having first and second sides, indicia on the first side that is visible with illumination by visible light and that is of a nature to inform customers or potential customers about the item. Adhesive on the second side causes the label to adhere to the item, and printing on the second side is visible only upon upon illumination by electromagnetic waves outside of the visible light spectrum and is of a nature to indicate genuineness of the label and thereby to indicate genuineness of the item. The genuineness of the item can be determined by removal of the label from the item, illumination of the second side with the electromagnetic waves outside of the visible light spectrum so that the printing on the second side is visible and recognition of the printing on the second side as an indicator of genuineness of the label and the item.

36 Claims, 3 Drawing Sheets

LABELS FOR DETECTING COUNTERFEIT PRODUCTS

BACKGROUND OF THE INVENTION (1) Field of the Invention

The present invention relates to the identification of genuine goods provided by a source of such goods and the differentiation of counterfeit goods therefrom. In particular, the invention relates to the marking of labels that are adhesively applied to such genuine goods. More particularly, the invention relates to such labels that are marked with ink that is not visible when exposed to visible light. Still more particularly, the invention relates to labels having a bottom adhesive surface that is marked with such ink. Even more particularly, the invention relates to such labels wherein the markings applied to the adhesive surface correlate with a code that is normally visible on the top surface of the label.

(2) Description of the Prior Art

The production and sale of counterfeit consumer goods pose a major concern for those who manufacture and sell the true - or genuine - version of such goods. The sale of such goods diminishes the strength and reputation of the service and trade marks associated with such items, reduces the income realized by those who make and sell the genuine item, and confuses the buying public as to the source and quality of those goods in the marketplace.

One technique that is commonly use to ascertain the authenticity of a product is to apply some sort of indicia to the goods. A manufacturer or retailer might then inspect suspect goods for the mark and thus determine whether or not they are counterfeit or genuine. The mark is ideally one that would be difficult for a counterfeiter to duplicate or detect. Such identifying indicia can be applied directly to a product, or, as a less expensive alternative, to the packaging of the product.

The prior art has adopted the approach of marking the packaging or labeling of a product rather than the product itself. If a counterfeiter develops a way to reproduce the distinguishing indicia applied to the genuine product, new packaging or labels bearing different indicia can be readily produced without re-marking the goods themselves, thereby minimizing financial loss. By applying such indicia with ink that is invisible under the 'normal' or visible spectrum of electromagnetic radiation, the likelihood that a counterfeiter would detect the distinguishing mark, copy it, and incorporate it into the packaging of the counterfeit goods can be substantially reduced. Way (European Patent 0 342 982; published 1989) describes a self-adhesive tape label having indicia printed in ink that is not visible under the normal spectrum of light and is preferably visible under ultraviolet light. The indicia are printed on the top or product information surface—i.e., the surface opposite the adhesive layer - and may be covered with a transparent layer of polymeric material. Similarly, the label of Chouinard (U.S. Pat. No. 4,889,365; issued 1989) has both visible and invisible indicia printed on the outer product information side of the label. Although they teach that indicia should be applied with ink that is not visible to the naked eye, these prior-art labels place the indicia at a location where an enterprising counterfeiter equipped with an ultraviolet lamp is most likely to search for a security mark—the outward-facing product information side of the label. Once discovered, the indicia themselves can be copied and applied to the labeling of the counterfeit products.

A more complex solution involves physically concealing the indicia under a series of opaque layers. The multi-layer label of Marino et al. (U.S. Pat. No. 5,605,230; issued 1997), intended for permanent application to pharmaceutical containers, conceals printed indicia under a removable protective sleeve that carries an outer label. When the sleeve is removed, the underlying indicia are exposed, thereby assuring authenticity. Green et al. (U.S. Pat. No. 5,042,842; issued 1991) also describes an adhesive-backed, multi-layer security label. Indicia or markings are applied to the bottom layer of the label that is permanently attached to a product. The label also includes a permanently patterned adhesive so formed as to reveal a portion of the indicia when a portion of the label is removed. To provide a further measure of security, the markings in the label of Green et al. may be printed in a fluorescent dye or ink that is sensitive to ultraviolet light in order to avoid immediate detection by a counterfeiter. Because such multi-layer prior-art markers are intended for permanent application to the genuine product itself or the product container, they are not appropriate for use with goods—such as clothing—having labels that are readily discarded. Moreover, the multi-layer construction of these prior-art labels makes them too expensive for use as discardable labels.

The prior-art labels that employ such anti-counterfeiting measures are either too easily detected and overcome by would-be counterfeiters or too costly to be used for labels that are readily discarded. Therefore, what is needed is an adhesive-backed label bearing anti-counterfeiting and security indicia that are not printed on the outward-facing surface of the label. In addition, what is needed is an anti-counterfeiting, adhesive-backed label bearing security indicia that are not visible when exposed to the visible spectrum of light. What is also needed is an anti-counterfeiting, adhesive-backed label that can be used in applications where the label is often removed from the product marked by the label prior to use. Finally, what is needed is an anti-counterfeiting label that is relatively inexpensive to manufacture.

SUMMARY OF THE INVENTION

The present invention fulfills these needs in the art by providing an adhesive label capable of identifying authentic goods and assisting in the detection of counterfeit articles. The label is printable on both its top surface—i.e., the outwardly facing surface that normally bears product information—and its bottom surface, and is also coated with an adhesive on its bottom surface. Product information—i.e., information identifying the product and its source—is printed on the top surface of the label and is visible when the label is illuminated by visible light. Indicia are printed on the bottom adhesive-coated surface of the label using ink that is not visible when exposed to the visible portion of the electromagnetic spectrum.

A printable substrate has first and second sides, the second side being coated with an adhesive for affixing the label to the goods intended to be marked. The substrate may be any printable material, such as paper or a non-woven polymeric substance that is commonly used to prepare an adhesively-backed label. Indicia, located on the first side of the label and visible when exposed to the visible light, informs consumers about the goods marked with the label. A second set of indicia printed on the adhesive second side of the label indicates genuineness of goods marked by the label and is visible only when illuminated by electromagnetic waves outside of the visible light spectrum. The label may further include release paper that covers and protects the adhesive second side—and the printing thereon - prior to application of the label to genuine goods. When marked with such a label, the genuineness of goods can be determined by removing the label from the goods and illuminating the label with electromagnetic radiation that is outside the visible light spectrum, thereby making the printed indicia applied to the label on genuine goods visible. Conversely, non-genuine or counterfeit goods can be identified by removing the label from the goods and illuminating the adhesive-coated second side of the non-genuine label with radiation of the same wavelength to reveal the absence of printed indicia.

The indicia printed on the adhesive second side of the label may be visible when exposed to ultraviolet radiation. A phosphorescent dye having a greenish or bluish hue when illuminated with ultraviolet radiation may be selected. Non-authenticity may be indicated when printing having a different hue than the phosphorescent hue is visible when the adhesive, second side of a label attached to non-genuine or counterfeit goods is illuminated with ultraviolet radiation.

As yet a further step to detect counterfeiting of such goods, normally visible indicia on the first side of the label can be correlated with the markings printed on the adhesive second side of the label. A label can be determined to be non-genuine if a lack of correlation in the indicia and the printing that is visible only under ultraviolet light.

The present invention also provides a supply of labels that can help detect counterfeit articles. The supply of labels includes a sheet of release paper having one side that is coated to inhibit permanent adhesion of labels thereto, even when contacted by an adhesive-coated side of the labels. A plurality of labels is temporarily adhered to the coated side of the sheet of release paper by adhesive adhered to the labels. The labels include a printable substrate having first and second sides and indicia on the first side that is visible with illumination by visible light and is of a nature to inform consumers about goods marked with the label. Adhesive on the second side causes the labels to temporarily adhere to the release paper and to cause the label later to adhere to goods to be marked with the label. Printing on the second side is not visible with illumination by visible light but is visible upon illumination by electromagnetic radiation outside the visible light spectrum. The printing on the second side is of a nature to indicate genuineness of the label and thereby to indicate genuineness of goods marked by the label.

Genuine goods marked with the labels that have been transferred from the release paper to the goods can be determined to be genuine by first removing the label from the goods. The second side of the label is then illuminated with electromagnetic radiation that is outside the visible light spectrum so that the printing on the second side is visible. The genuineness of the label is then ascertained through recognition of the printing on the second side as an indicator of authenticity. Conversely, non-genuine goods can be identified as such by removing a non-genuine label from goods under scrutiny. When illuminated with the same electromagnetic radiation outside the visible light spectrum, the absence of printing on the adhesive second side of the non-genuine label would indicate the non-genuineness of the label and the goods to which it is applied.

Still another aspect of the present invention also provides a commercial product bearing a label to help detect counterfeit versions of the product. The product includes an item having commercial value and a label adhesively affixed to the item having characteristics and utility as described above.

BRIEF DESCRIPTION OF THE DRAWINGS

The invention will be better understood by a reading of the Detailed Description of the Preferred Embodiments along with a review of the drawings, in which.

5

DETAILED DESCRIPTION OF THE PREFERRED EMBODIMENTS

Figure 1A:
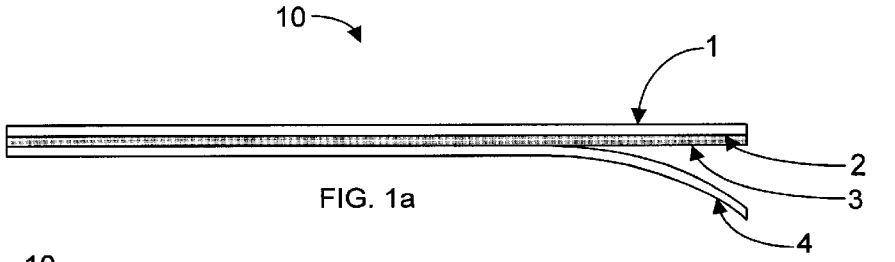
FIG. 1*a* is a cross-sectional view of the label according to the Preferred Embodiment of the present invention.

In the following description, like reference characters designate like or corresponding parts throughout the several views shown in the figures. It is also understood that terms such as "top," "bottom," "outward," "inward" and the like are words of convenience and are not to be construed as limiting terms.

Referring now to the drawings in general, it will be understood that the illustrations are for the purpose of describing the preferred embodiments of the invention and are not intended to limit the invention thereto.

Figure 1B:
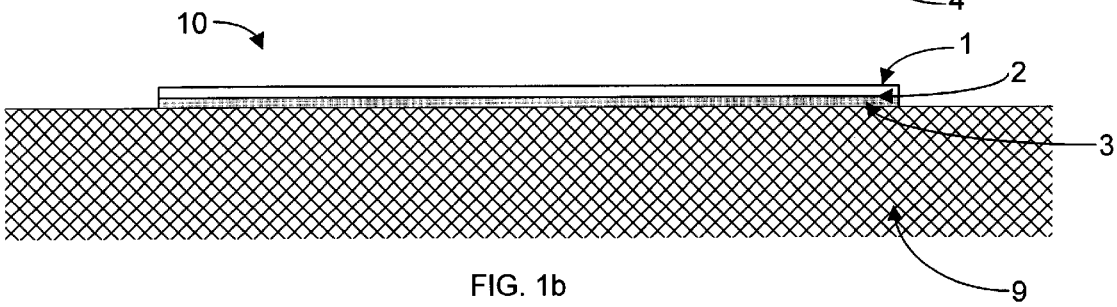
FIG. 1*b* is a cross-sectional view of the label of FIG. 1 a affixed to the item it is intended to identify.

A cross-sectional view of a label 10 according to the present invention is shown in FIG. 1*a*. The label 10 has a top surface 1 facing outward and a bottom surface 2 that is coated with an adhesive layer 3. A releasable backing strip 4, preferably of paper, covers the adhesive layer 3 until the label 10 is applied to an item 9 (see FIG. 5*a*) that the label 10 is intended to identify. The releasable backing strip 4 has one side coated such as with silicone, to inhibit permanent adhesion of the labels thereto. FIG. 1*b* is a cross-sectional view of a label 10 that has been affixed to an item 9. The adhesive layer 3 holds the label 10 to the item 9, with the top surface 1 facing outward and the bottom surface 2 facing the item 9. At this point, the releasable backing strip 4 has been removed from the label 10.

Figure 2A:
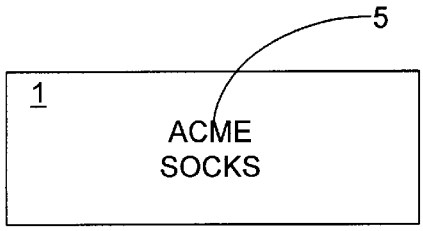
FIG. 2*a* is a view of the top surface of the label of FIG. 1*a* as seen under visible light.
Figure 2B:
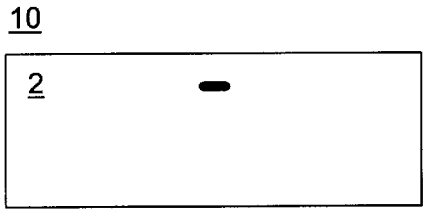
FIG. 2*b* is a view of the bottom surface of the label of FIG. 1*a* as viewed under visible light.

As seen in FIG. 2*a*, the top surface 1 of the label 10 bears indicia 5 that are readily visible to the consumer under normal lighting conditions—i.e., under light in the so-called visible portion of the radiation spectrum. Indicia 5 may include information concerning trademarks, product information, product source identification, or any information conventionally included on such a label. When viewed under normal lighting conditions, the bottom surface 2 of the label 10, shown in FIG. 2*b*, bears no visible markings.

Figure 2C:
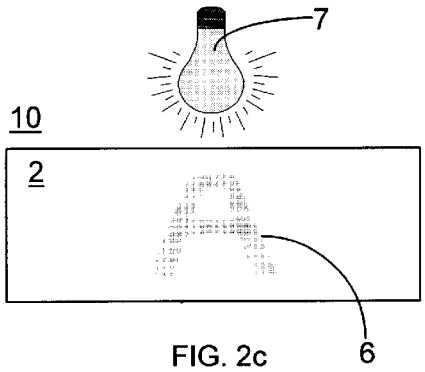
FIG. 2*c* is a view of the bottom surface of the label of FIG. 1*a* when viewed under ultraviolet radiation.

Markings 6 are printed on the bottom surface 2, however, using an ink or dye that is visible when exposed to a source of light 7 emitting radiation outside the visible light spectrum, as shown in FIG. 2*c*. In the preferred embodiment, inks and phosphorescent dyes that are visible under ultraviolet light are used to apply markings 6 to the bottom surface 2. To enhance security, markings 6 may be located at a predetermined location and have a predetermined configuration. Thus, a marking that is mislocated or has an incorrect configuration would be indicative of non-genuineness. As a further security measure, the specific hue emitted by the phosphorescent dye can be carefully controlled by adjusting mixtures. If counterfeiters then attempt to copy this measure, a failure to match the hue will indicate non-genuineness.

Similarly, the dye or ink can be selected to be responsive to a specific UV or other no-visible frequency range, so that illumination with that specific range is necessary to see the genuine printing. If the counterfeiter uses a dye responsive to a different UV range, for example, in an attempt to foil the system, such attempt would fail due to failure to match the specific dye or ink.

Figure 3:
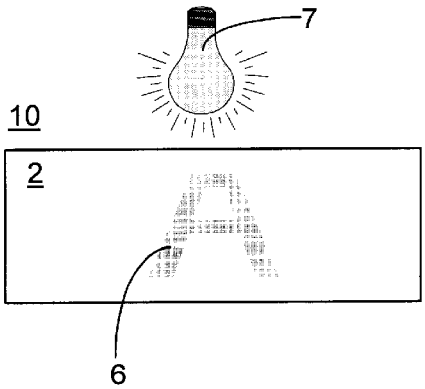
FIG. 3 is a comparison of the bottom surface of the label of FIG. 1*a* and the bottom surface of a label used to mark counterfeit goods when viewed under ultraviolet radiation.
Figure 3:
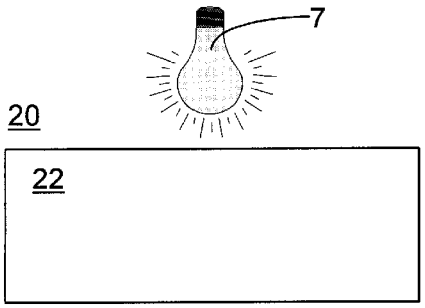

FIG. 3 illustrates a comparison of the label 10 of the present invention, which is used to mark genuine or authentic items 9, with a counterfeit label 20 used on counterfeit or non-authentic items. The top surface 21 of the counterfeit label 20 may bear indicia that is indistinguishable from the indicia 5 present on the top surface of the label 10 affixed to a genuine item 9. When the bottom surface 22 of the counterfeit label 20 is exposed to a source of light 7 emitting radiation outside the visible light spectrum, however, the marking 6 that is normally observed on the bottom surface 2 of the label 10 of the present invention under such light is not seen. The absence of the marking 6 under these conditions is indicative that the goods to which the label 20 is attached are not authentic.

Figure 4:
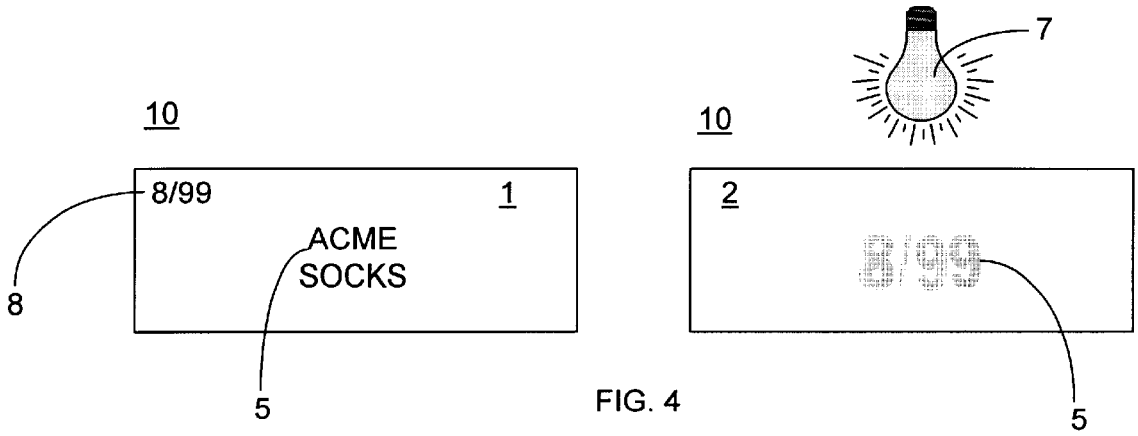
FIG. 4 is a view of the top and bottom surfaces of the label according to a second embodiment of the present invention bearing visible indicia that correlate with the indicia printed on the bottom surface in ultraviolet-visible ink.

As a further step to aid the detection of counterfeit goods, the top surface 1 of the label 10 may also bear information 8, such as a date of manufacture or SKU identifier, that correlates with the marking 6 that is present on the bottom surface 2. As seen in FIG. 4, information 8 may be printed on the top surface 1 and is visible under normal lighting conditions. A lack of correlation between the information 8 present on the top surface 1 and the marking 6 on the bottom surface 2 would serve to identify a suspect label and the goods to which it is attached as non-genuine.

Figure 5A:
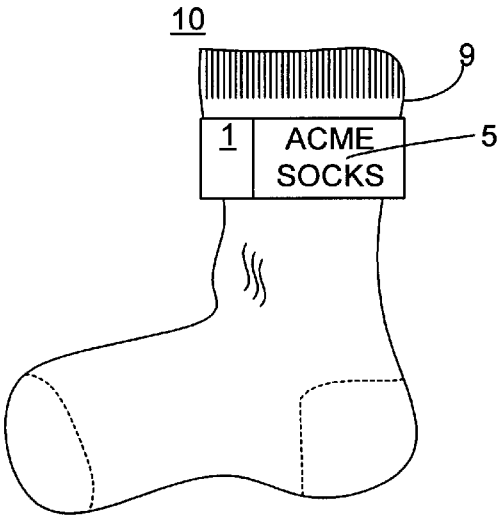
FIG. 5*a* is a perspective view of an item bearing a label according to the present invention.
Figure 5B:
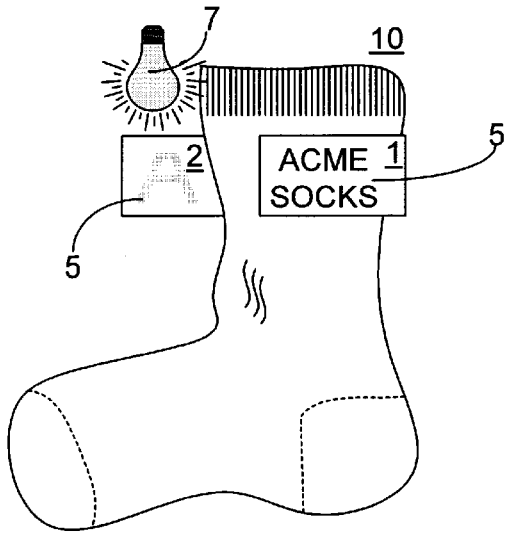
FIG. 5*b* is a perspective view of an item bearing the item of FIG. 5*a* in which the label has been partially removed from the item and the bottom surface of the label has been exposed to ultraviolet light to verify authenticity.

FIG. 5*a* shows a label 10 affixed to an item 9 of clothing, such as a pair of socks. The top surface 1 of the label 10 faces outward, while the bottom surface 2 and the marking 6 confirming the authenticity of the label 10 and the item 9 affixed thereto are hidden from plain view, thereby providing an added measure of security. A would-be counterfeiter inspecting the top surface 1 for a hidden mark that may be copied would not detect the marking 6. The genuineness of the item 9 can be simply determined by removing the label 10 from the item 9 and illuminating the bottom surface 2 with a non-visible light source 7, as shown in FIG. 5*b*. If the item 9 is indeed genuine, the marking 6 will be observable. Conversely, if the item 9 is not genuine, then no marking 6 will be seen.

Figure 6:
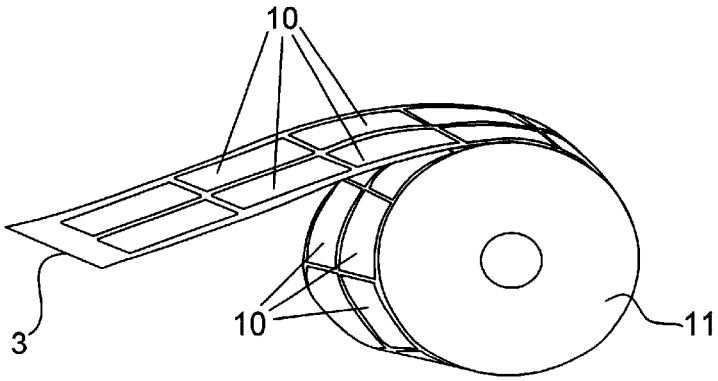
FIG. 6 shows a plurality of labels temporarily attached to a single sheet of release paper and dispensed in a roll.

For economy and ease of use, a number of labels 10 may be temporarily affixed to a single strip of release paper 3, as shown in FIG. 6, and dispensed as a roll 11. This is particularly convenient when the labels are acquired in bulk by the manufacturer of the item to be labeled.

Figure 7:
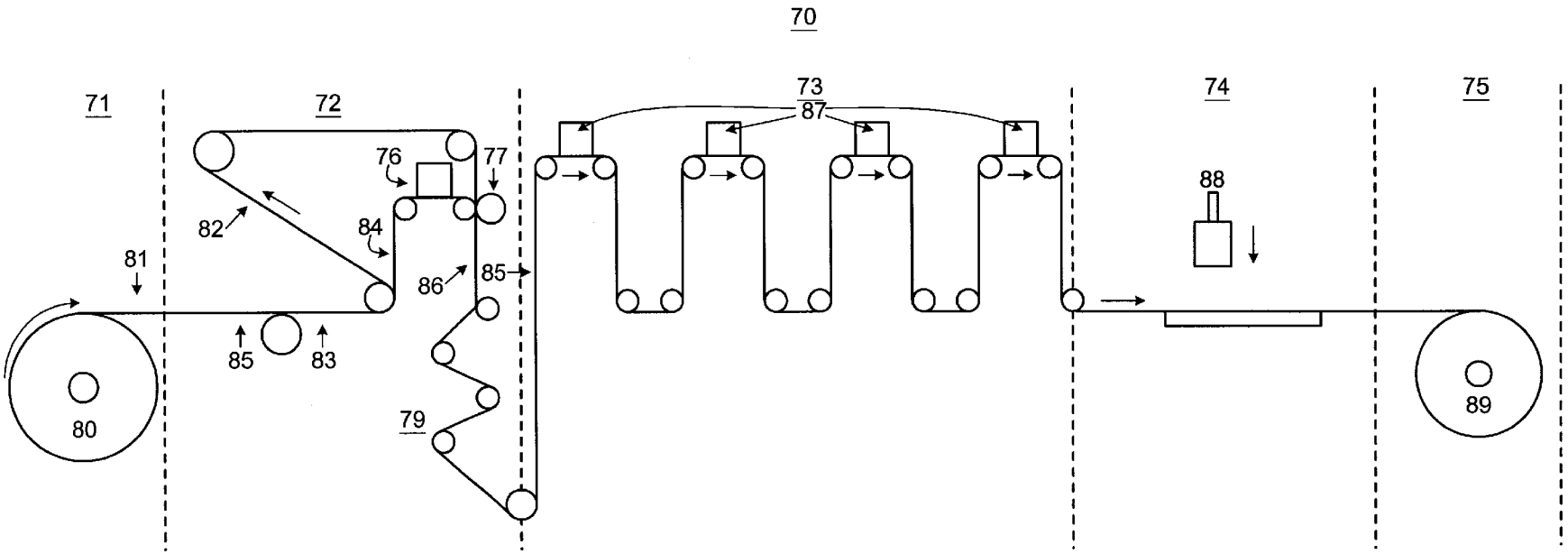
FIG. 7 is a schematic representation of the apparatus that is used to prepare a plurality of labels according to the present invention.

Using the apparatus 70 shown in FIG. 7, a plurality of labels can be prepared from a roll 80 comprising an adhesively-backed strip 83 of paper temporarily bonded to a releasable backing strip 82. The front end 71 of the apparatus 70 includes a support (not shown) for the roll 80 and tensioning guide rollers support (not shown) to effect a selected tension on the bonded strip 81. The arrangement and use of such guide rollers will be apparent to those of ordinary skill in the art. The bonded strips 81 are rolled such that the non-adhesive top surface of the paper strip faces inward on the roll 80. The bonded strip 81 is fed from the roll 80 into the separation portion 72 of the apparatus 70. The backing strip 82 is physically separated from the adhesively-backed paper strip 83 by being diverted to a different path, exposing the bottom adhesive surface 84 of the adhesively-backed paper strip 83. The adhesively-backed paper strip 83 passes through a printing station 76 where a marking 6 is printed on the bottom adhesive surface 84 of the strip, while the releasable backing 82 is drawn along a separate path. The bottom adhesive surface 84 faces upward during the printing step, and the printing station 76 is preferably a flexographic roller. Alternatively, if changeable patterns are preferred, a variable printer such as an inkjet printer could be substituted. After the marking 6 has been printed on the bottom adhesive surface 84, the releasable backing strip 82 and bottom adhesive surface 84 of the adhesively-backed paper strip 83 are brought back into contact with each other and re-bonded by passing through a pair of rollers 77.

Once the releasable backing strip 82 and adhesively backed paper strip 83 have been rejoined, the top surface 85 of the adhesively-backed paper strip 83 is be reoriented 180 degrees to an upward-facing position in order to permit product information 8 to be printed thereon. To accomplish this, the rejoined paper strip and releasable backing 86 are fed through a series of 45 degree roller bars 79 in a known way. Product information 8 is then applied to the top surface of the paper strip by a four-color printing process 73, typically by flexographic printing. Individual labels 10 are the die-cut to a desired shape from the paper strip 83 at a die-cutting station 74, while the backing strip 82 remains intact. The finished labels 10 remain adhered to the releasable backing strip 82 and are rolled into finished rolls 89 at a rolling station 75. The roll of labels 10 can be shipped to a commercial goods plant to be applied to merchandise.

Certain modifications and improvements will occur to those skilled in the art upon a reading of the foregoing description. For example, the information that correlates with the marking on the adhesive second side is not necessarily limited to a date of manufacture or SKU identifier, and the marking may be visible when illuminated by other types of radiation, such as a laser. It should be understood that all such modifications and improvements have been deleted herein for the sake of conciseness and readability but are properly within the scope of the following claims.

What is claimed is:

1. A label to help detect counterfeit articles comprising:

(a) a printable substrate having first and second sides;

(b) indicia on the first side that is visible with illumination by visible light and that is of a nature to inform potential customers about goods marked with the label;

(c) adhesive on the second side to cause the label to adhere to goods to be marked with the label wherein the adhesive is a type that adheres the label to the goods but enables removal of the label from the goods without damaging the goods or the label; and (d) printing on the second side that is not visible with illumination by visible light but that is visible upon illumination by electromagnetic waves outside of the visible light spectrum and that is of a nature to indicate genuineness of the label and thereby to indicate genuineness of goods marked by the label;

whereby genuine goods marked with the label can be determined to be genuine by removal of the label from the goods, illumination of the second side with the electromagnetic waves outside of the visible light spectrum so that the printing on the second side is visible and recognition of the printing on the second side as an indicator of genuineness of the label, and whereby non-genuine goods can be determined not to be genuine by removal of a non-genuine label from goods under scrutiny, illumination of an adhesive-coated side of the non-genuine label with the electromagnetic waves outside of the visible light spectrum so that any printing on the second side would be visible and recognition of the absence of printing on the second side of the non-genuine label as indicating the non-genuineness of the non-genuine label and the goods to which it is applied, permitting the genuineness of the label to be inspected and the label to be reapplied to the goods.

2. The label to help detect counterfeit articles as claimed in claim 1 wherein the printing on the second side is visible when illuminated with ultraviolet radiation.

3. The label to help detect counterfeit articles as claimed in claim 1 wherein the printing on the second side is a phosphorescent dye.

4. The label to help detect counterfeit articles as claimed in claim 1 wherein the printing on the second side is a phosphorescent dye that appears in a particular hue when illuminated with ultraviolet radiation and illumination of the second side of non-genuine goods with ultraviolet radiation that results in the failure of appearance of visible printing in the particular hue is an indicator of non-genuineness.

5. The label to help detect counterfeit articles as claimed in claim 1 further comprising release paper on the second side covering the second side adhesive and second side printing prior to application to genuine goods.

6. The label to help detect counterfeit articles as claimed in claim 1 wherein the indicia on the first side and the printing on the second side are correlated so that differences in the indicia on genuine goods dictate differences in the printing on the second side of labels for genuine goods and a label can be determined to be non-genuine by a lack of correlation in observed indicia and visible printing when illuminated with the electromagnetic waves outside of the visible light spectrum.

7. The label to help detect counterfeit articles as claimed in claim 6 wherein the correlated indicia is selected from the group consisting of a date code or an SKU identifier.

8. A supply of labels to help detect counterfeit articles comprising:

(a) a sheet of release paper having one side that is coated to inhibit permanent adhesion of labels thereto, even when contacted by an adhesive-coated side of the labels;

(b) a plurality of labels temporarily adhered to the one side of the sheet of release paper by adhesive adhered to the labels, in which the labels include a printable substrate having first and second sides, indicia on the first side that is visible with illumination by visible light and that is of a nature to inform potential customers about goods marked with the label;

(c) adhesive on the second side which causes the labels to temporarily adhere to the release paper and to cause the label to adhere to goods to be marked with the label wherein the adhesive is a type that adheres the label to the goods but enables removal of the label from the goods without damaging the goods or the label; and (d) printing on the second side that is not visible with illumination by visible light but that is visible upon illumination by electromagnetic waves outside of the visible light spectrum and that is of a nature to indicate genuineness of the label and thereby to indicate genuineness of goods marked by the label, whereby genuine goods marked with the labels that have been transferred from the release paper can be determined to be genuine by removal of the label from the goods, illumination of the second side with the electromagnetic waves outside of the visible light spectrum so that the printing on the second side is visible and recognition of the printing on the second side as an indicator of genuineness of the label, and whereby non-genuine goods can be determined not to be genuine by removal of a non-genuine label from goods under scrutiny, illumination of an adhesive-coated side of the non-genuine label with the electromagnetic waves outside of the visible light spectrum so that any printing on the second side would be visible and recognition of the absence of printing on the second side of the non-genuine label as indicating the non-genuineness of the non-genuine label and the goods to which it is applied, permitting the genuineness of the label to be inspected and the label to be reapplied to the goods.

9. A supply of labels to help detect counterfeit articles as claimed in claim 8 wherein the labels are configured to serve as wrappers to join socks together for shipment and sale.

10. A commercial product having a label to help detect counterfeit ones of the product comprising:

(a) an item having commercial value;

(b) a label adhered to the item, the label including a printable substrate having first and second sides, indicia on the first side that is visible with illumination by visible light and that is of a nature to inform potential customers about the item; and (c) adhesive on the second side that causes the label to adhere to the item wherein the adhesive is a type that adheres the label to the goods but enables removal of the label from the goods without damaging the goods or the label, and printing on the second side that is not visible with illumination by visible light but that is visible upon illumination by electromagnetic waves outside of the visible light spectrum and that is of a nature to indicate genuineness of the label and thereby to indicate genuineness of the item, whereby the genuineness of the item can be determined by at least partial removal of the label from the item to expose the second side of the label, illumination of the second side with the electromagnetic waves outside of the visible light spectrum so that the printing on the second side is visible and recognition of the printing on the second side as an indicator of genuineness of the label and the item, and permitting the genuineness of the label to be inspected and the label to be reapplied, and whereby non-genuine goods can be determined not to be genuine by removal of a non-genuine label from goods under scrutiny, illumination of an adhesive-coated side of the non-genuine label with the electromagnetic waves outside of the visible light spectrum so that any printing on the second side would be visible and recognition of the absence of printing on the second side of the non-genuine label as indicating the non-genuineness of the non-genuine label and the goods to which it is applied.

11. The commercial product as claimed in claim 10 wherein the printing on the second side of the label is a phosphorescent dye visible when illuminated with ultraviolet radiation.

12. The commercial product as claimed in claim 10 wherein the product is a textile product.

13. The commercial product as claimed in claim 10 wherein the product is a pair of socks and the label is configured to serve as a wrapper that joins the socks together for shipment and sale.

14. The commercial product as claimed in claim 10 wherein the indicia on the first side and the printing on the second side are correlated so that differences in the indicia on genuine goods dictate differences in the printing on the second side of labels for genuine goods and a label can be determined to be non-genuine by a lack of correlation in observed indicia and visible printing when illuminated with the electromagnetic waves outside of the visible light spectrum.

15. The commercial product as claimed in claim 14 wherein the correlated indicia is a date code.

16. The commercial product as claimed in claim 14 wherein the correlated indicia is an SKU identifier.

17. A retailable pair of socks having a label to help detect counterfeit ones of the socks comprising:

a) a pair of socks;

b) a label adhered to the socks and joining the socks for shipment and sale, the label including a printable substrate having first and second sides, indicia on the first side that is visible with illumination by visible light and that is of a nature to inform customers and potential customers about the socks;

c) adhesive on the second side that causes the label to adhere to the socks wherein the adhesive is a type that adheres the label to the goods but enables removal of the label from the goods without damaging the goods or the label; and d) printing on the second side in a phosphorescent dye that is visible when illuminated with ultraviolet radiation and that is not visible with illumination by visible light and that is of a nature to indicate genuineness of the label and thereby to indicate genuineness of the socks, whereby the genuineness of the socks can be determined by removal of the label from the socks, illumination of the second side with ultraviolet radiation so that the printing on the second side is visible and recognition of the printing on the second side as an indicator of genuineness of the label and the socks, and permitting the label to be reapplied, for the sale of the socks, whereby non-genuine socks can be determined not to be genuine by removal of a non-genuine label from socks under scrutiny, illumination of an adhesive-coated side of the non-genuine label with ultraviolet radiation so that any printing on the second side would be visible, and recognition of the absence of printing on the second side of the non-genuine label as indicating the non-genuineness of the non-genuine label and the socks to which it is applied.

18. The retailable pair of socks as claimed in claim 17 wherein the indicia on the first side and the printing on the second side are correlated so that differences in the indicia of genuine goods dictate differences in the printing on the second side of labels for genuine goods and a label can be determined to be non-genuine by a lack of correlation in observed indicia and visible printing when illuminated with ultraviolet radiation.

19. A method of checking the genuineness of goods comprising:

a) acquiring goods the genuineness of which is to be determined;

b) at least partially removing a label adhered to the acquired goods to expose at least a part of a backside of the label without damaging the label;

c) illuminating the backside of the label with electromagnetic radiation that is not visible radiation; and d) observing the illuminated backside to ascertain if any images become visible upon illumination with the electromagnetic radiation.

20. The method of checking the genuineness of goods as claimed in claim 19 further comprising comparing any observed images with an image that would be expected from genuine goods to determine if the goods are genuine.

21. The method of checking the genuineness of goods as claimed in claim 20 wherein the act of comparing includes comparing the color of an observed image with the color of an image that would be expected from genuine goods to determine if the goods are genuine.

22. The method of checking the genuineness of goods as claimed in claim 20 wherein the act of comparing includes comparing the location of an observed image with the location of an image that would be expected from genuine goods to determine if the goods are genuine.

23. A method of checking the genuineness of goods as claimed in claim 20 wherein the act of comparing includes comparing the configuration of an observed image with the configuration of an image that would be expected from genuine goods to determine if the goods are genuine.

24. A method of manufacturing goods that may be subject to counterfeiting comprising:

a) manufacturing an item of value;

b) acquiring labels that include a printable substrate having first and second sides, indicia on the first side that is visible with illumination by visible light and that is of a nature to inform potential customers about the items of value to be marked with the labels, printing on the second side that is not visible with illumination by visible light but that is visible upon illumination by electromagnetic waves outside of the visible light spectrum, and adhesive on the second side wherein the adhesive is a type that adheres the label to the goods but enables removal of the label from the goods without damaging the goods or the label; and c) adhering the labels to the items of value to indicate genuineness of the label and thereby to indicate genuineness of items marked by the label, whereby genuine items marked with the labels can be determined to be genuine by removal of the label from the goods, illumination of the second side with the electromagnetic waves outside of the visible light spectrum so that the printing on the second side is visible and recognition of the printing on the second side as an indicator of genuineness of the label, and whereby non-genuine goods can be determined not to be genuine by removal of a non-genuine label from goods under scrutiny, illumination of an adhesive-coated side of the non-genuine label with the electromagnetic waves outside of the visible light spectrum so that any printing on the second side would be visible and recognition of the absence of printing on the second side of the non-genuine label as indicating the non-genuineness of the non-genuine label and the goods to which it is applied.

25. A label to help detect counterfeit articles comprising:

(a) a printable substrate having first and second sides;

(b) adhesive on substantially all of the second side to cause the label to adhere to goods to be marked with the label; and (c) indicia on the first side that is visible with illumination by visible light and that is of a nature to inform potential customers about goods marked with the label;

(d) printing on the second side coextensive with at least part of the adhesive on the second side, the printing being of an ink that is not visible with illumination by visible light but that is visible upon illumination by electromagnetic waves outside of the visible light spectrum and that is of a nature to indicate genuineness of the label and thereby to indicate genuineness of goods marked by the label, whereby genuine goods marked with the label can be determined to be genuine by removal of the label from the goods, illumination of the second side with the electromagnetic waves outside of the visible light spectrum so that the printing on the second side is visible and recognition of the printing on the second side as an indicator of genuineness of the label, and whereby non-genuine goods can be determined not to be genuine by removal of a non-genuine label from goods under scrutiny, illumination of an adhesive-coated side of the non-genuine label with the electromagnetic waves outside of the visible light spectrum so that any printing on the second side would be visible and recognition of the absence of printing on the second side of the non-genuine label as indicating the non-genuineness of the non-genuine label and the goods to which it is applied.

26. The label to help detect counterfeit articles as claimed in claim 25 wherein the printing on the second side is visible when illuminated with ultraviolet radiation.

27. The label to help detect counterfeit articles as claimed in claim 25 wherein the printing on the second side is a phosphorescent dye.

28. The label to help detect counterfeit articles as claimed in claim 25 wherein the printing on the second side is a phosphorescent dye that appears in a particular hue when illuminated with ultraviolet radiation and illumination of the second side of non-genuine goods with ultraviolet radiation that results in the failure of appearance of visible printing in the particular hue is an indicator of non-genuineness.

29. The label to help detect counterfeit articles as claimed in claim 25 further comprising release paper on the second side covering the second side adhesive and second side printing prior to application to genuine goods.

30. The label to help detect counterfeit articles as claimed in claim 25 wherein the indicia on the first side and the printing on the second side are correlated so that differences in the indicia on genuine goods dictate differences in the printing on the second side of labels for genuine goods and a label can be determined to be non-genuine by a lack of correlation in observed indicia and visible printing when illuminated with the electromagnetic waves outside of the visible light spectrum.

31. A label to help detect counterfeit articles comprising:

(a) a printable substrate having first and second sides;

(b) indicia on the first side that is visible with illumination by visible light and that is of a nature to inform potential customers about goods marked with the label;

(c) adhesive on the second side to cause the label to adhere to goods to be marked with the label; and (d) printing that is on the on a portion of the second side having adhesive, that is not visible with illumination by visible light but that is visible upon illumination by electromagnetic waves outside of the visible light spectrum and that is of a nature to indicate genuineness of the label and thereby to indicate genuineness of goods marked by the label, whereby genuine goods marked with the label can be determined to be genuine by removal of the label from the goods, illumination of the second side with the electromagnetic waves outside of the visible light spectrum so that the printing on the second side is visible and recognition of the printing on the second side as an indicator of genuineness of the label, and whereby non-genuine goods can be determined not to be genuine by removal of a non-genuine label from goods under scrutiny, illumination of an adhesive-coated side of the non-genuine label with the electromagnetic waves outside of the visible light spectrum so that any printing on the second side would be visible and recognition of the absence of printing on the second side of the non-genuine label as indicating the non-genuineness of the non-genuine label and the goods to which it is applied.

32. A supply of labels to help detect counterfeit articles comprising:

(a) a sheet of release paper having one side that is coated to inhibit permanent adhesion of labels thereto, even when contacted by an adhesive-coated side of the labels;

(b) a plurality of labels temporarily adhered to the one side of the sheet of release paper by adhesive adhered to the labels, in which the labels include a printable substrate having first and second sides, indicia on the first side that is visible with illumination by visible light and that is of a nature to inform potential customers about goods marked with the label;

(c) adhesive on the second side which causes the labels to temporarily adhere to the release paper and to cause the label to adhere to goods to be marked with the label; and (d) printing that is on a portion of the second side having the adhesive, that is not visible with illumination by visible light but that is visible upon illumination by electromagnetic waves outside of the visible light spectrum, and that is of a nature to indicate genuineness of the label and thereby to indicate genuineness of goods marked by the label, whereby genuine goods marked with the labels that have been transferred from the release paper can be determined to be genuine by removal of the label from the goods, illumination of the second side with the electromagnetic waves outside of the visible light spectrum so that the printing on the second side is visible and recognition of the printing on the second side as an indicator of genuineness of the label, and whereby non-genuine goods can be determined not to be genuine by removal of a non-genuine label from goods under scrutiny, illumination of an adhesive-coated side of the non-genuine label with the electromagnetic waves outside of the visible light spectrum so that any printing on the second side would be visible and recognition of the absence of printing on the second side of the non-genuine label as indicating the non-genuineness of the non-genuine label and the goods to which it is applied.

33. A commercial product having a label to help detect counterfeit ones of the product comprising:

(a) an item having commercial value;

(b) a label adhered to the item, the label including a printable substrate having first and second sides, indicia on the first side that is visible with illumination by visible light and that is of a nature to inform potential customers about the item; and (c) adhesive on the second side that causes the label to adhere to the item, and printing, that is on a portion of the second side having the adhesive, that is not visible with illumination by visible light but that is visible upon illumination by electromagnetic waves outside of the visible light spectrum, and that is of a nature to indicate genuineness of the label and thereby to indicate genuineness of the item, whereby the genuineness of the item can be determined by at least partial removal of the label from the item to expose the second side of the label, illumination of the second side with the electromagnetic waves outside of the visible light spectrum so that the printing on the second side is visible and recognition of the printing on the second side as an indicator of genuineness of the label and the item, and whereby non-genuine goods can be determined not to be genuine by removal of a non-genuine label from goods under scrutiny, illumination of an adhesive-coated side of the non-genuine label with the electromagnetic waves outside of the visible light spectrum so that any printing on the second side would be visible and recognition of the absence of printing on the second side of the non-genuine label as indicating the non-genuineness of the non-genuine label and the goods to which it is applied.

34. A retailable pair of socks having a label to help detect counterfeit ones of the socks comprising:

a) a pair of socks;

b) a label adhered to the socks and joining the socks for shipment and sale, the label including a printable substrate having first and second sides, indicia on the first side that is visible with illumination by visible light and that is of a nature to inform customers and potential customers about the socks;

c) adhesive on the second side that causes the label to adhere to the socks; and d) printing that is on a portion of the second side having the adhesive in a phosphorescent dye that is visible when illuminated with ultraviolet radiation, that is not visible with illumination by visible light, and that is of a nature to indicate genuineness of the label and thereby to indicate genuineness of the socks, whereby the genuineness of the socks can be determined by removal of the label from the socks, illumination of the second side with ultraviolet radiation so that the printing on the second side is visible and recognition of the printing on the second side as an indicator of genuineness of the label and the socks, and whereby non-genuine socks can be determined not to be genuine by removal of a non-genuine label from socks under scrutiny, illumination of an adhesive-coated side of the non-genuine label with ultraviolet radiation so that any printing on the second side would be visible, and recognition of the absence of printing on the second side of the non-genuine label as indicating the non-genuineness of the non-genuine label and the socks to which it is applied.

35. A method of checking the genuineness of goods comprising:

a) acquiring goods the genuineness of which is to be determined;

b) at least partially removing a label adhered to the acquired goods to expose at least a part of a backside of the label;

c) illuminating adhesive on the backside of the label with electromagnetic radiation that is not visible radiation; and d) observing the illuminated adhesive to ascertain if any images become visible upon illumination with the electromagnetic radiation.

36. A method of manufacturing goods that may be subject to counterfeiting comprising:

a) manufacturing an item of value;

b) acquiring labels that include a printable substrate having first and second sides, indicia on the first side that is visible with illumination by visible light and that is of a nature to inform potential customers about the items of value to be marked with the labels, printing on the second side that is not visible with illumination by visible light but that is visible upon illumination by electromagnetic waves outside of the visible light spectrum, and adhesive on the second side at least partially coextensive with the printing on the second side; and c) adhering the labels to the items of value to indicate genuineness of the label and thereby to indicate genuineness of items marked by the label, whereby genuine items marked with the labels can be determined to be genuine by removal of the label from the goods, illumination of the second side with the electromagnetic waves outside of the visible light spectrum so that the printing on the second side is visible and recognition of the printing on the second side as an indicator of genuineness of the label, and whereby non-genuine goods can be determined not to be genuine by removal of a non-genuine label from goods under scrutiny, illumination of an adhesive-coated side of the non-genuine label with the electromagnetic waves outside of the visible light spectrum so that any printing on the second side would be visible and recognition of the absence of printing on the second side of the non-genuine label as indicating the non-genuineness of the non-genuine label and the goods to which it is applied.

* * * * *